US007201234B2

(12) United States Patent
Rogers et al.

(10) Patent No.: US 7,201,234 B2
(45) Date of Patent: Apr. 10, 2007

(54) RESIDENTIAL FIRE SPRINKLER

(75) Inventors: Kenneth W. Rogers, Horsham, PA (US); Mark E. Fesseden, Warwick, RI (US); Manuel R. Silva, Jr., Cranston, RI (US)

(73) Assignee: Tyco Fire Products LP, Cranston, RI (US)

( * ) Notice: Subject to any disclaimer, the term of this patent is extended or adjusted under 35 U.S.C. 154(b) by 0 days.

(21) Appl. No.: 11/000,128

(22) Filed: Dec. 1, 2004

(65) Prior Publication Data

US 2006/0113092 A1 Jun. 1, 2006

(51) Int. Cl.

| | |
|---|---|
| ***A62C 37/11*** | (2006.01) |
| ***A62C 37/14*** | (2006.01) |
| ***A62C 37/08*** | (2006.01) |
| ***B05B 1/26*** | (2006.01) |

(52) U.S. Cl. ..... 169/37; 169/41; 169/58; 239/498; 239/504; 239/524

(58) Field of Classification Search ..... 169/37, 169/41, 42, 46, 47, 56, 57, 58; 239/498, 239/504, 524

See application file for complete search history.

(56) References Cited

U.S. PATENT DOCUMENTS

| | | | | |
|---|---|---|---|---|
| 2,135,138 | A * | 11/1938 | Kendall | 239/498 |
| 4,580,729 | A * | 4/1986 | Pounder | 239/524 |
| 5,579,846 | A * | 12/1996 | Meyer et al. | 169/37 |
| 5,584,344 | A * | 12/1996 | Meyer et al. | 169/37 |
| 5,609,211 | A * | 3/1997 | Meyer et al. | 169/37 |
| 5,664,630 | A * | 9/1997 | Meyer et al. | 169/37 |
| 5,839,667 | A * | 11/1998 | Fischer | 239/498 |
| 5,865,256 | A * | 2/1999 | Pounder | 169/37 |
| 6,026,907 | A * | 2/2000 | Pahila | 169/37 |
| 6,059,044 | A * | 5/2000 | Fischer | 169/37 |
| 6,276,460 | B1 * | 8/2001 | Pahila | 169/37 |
| 6,516,893 | B2 * | 2/2003 | Pahila | 169/37 |
| 2003/0201341 | A1 * | 10/2003 | Wancho et al. | 239/498 |
| 2005/0178564 | A1 | 8/2005 | Orr | |

* cited by examiner

*Primary Examiner*—Kevin Shaver
*Assistant Examiner*—Darren Gorman
(74) *Attorney, Agent, or Firm*—Tyco Engineered Products & Services; Montgomery W. Smith; David Laub

(57) ABSTRACT

A pendent type residential fire sprinkler is described. The residential fire sprinkler has a body with a K-factor of at least 6 passage coupled to a deflector assembly that distributes fluid flowing through the passage over a coverage area to perform in accordance with Underwriters Laboratory Standard 1626 (October 2003) for listing by Underwriters Laboratory Incorporated so that the body and a heat responsive trigger disposed between the passage and the deflector assembly of the sprinkler can be installed in accordance with the 2002 Edition of National Fire Protection Association Standards 13, 13D, and 13R. Various aspects of the residential fire sprinkler, including a method of protecting a residential dwelling unit are described.

15 Claims, 5 Drawing Sheets

RESIDENTIAL FIRE SPRINKLER

BACKGROUND OF THE INVENTION

An automatic sprinkler system is one of the most widely used devices for fire protection. These systems have sprinklers that are activated once the ambient temperature in an environment, such as a room or a building, exceeds a predetermined value. Once activated, the sprinklers distribute fire-extinguishing fluid, preferably water, in the room or building. A sprinkler system, depending on its specified configuration is considered effective if it controls or suppresses a fire. Failures of such systems may occur when the system has been rendered inoperative during building alteration or disuse, or the occupancy hazard has been increased beyond initial system capability.

The sprinkler system can be provided with a suitable fire fighting fluid or a water supply (e.g., a reservoir or from a municipal water supply). Such supply may be separate from that used by a fire department. Regardless of the type of supply, the sprinkler system is provided with a main that enters the building to supply a riser. Connected at the riser are valves, meters, and, preferably, an alarm to sound when water flow within the system is above or below a predetermined minimum value. At the top of a vertical riser, a horizontally disposed array of pipes extends throughout the fire compartment in the building. Other risers may feed distribution networks to systems in adjacent fire compartments. Compartmentalization can divide a large building horizontally, on a single floor, and vertically, floor to floor. Thus, several sprinkler systems may serve one building.

In a piping distribution network, branch lines carry the sprinklers. A sprinkler may extend up from a branch line, placing the sprinkler relatively close to the ceiling, or a sprinkler can be pendent below the branch line. For use with concealed piping, a flush-mounted pendant sprinkler may extend only slightly below the ceiling.

Various standards exist for the design and installation of a fire protection system. In particular, the National Fire Protection Association ("NFPA") describes, in its *Standard for the Installation of Sprinkler Systems* 13 (2002) ("the NFPA 13") along with Standards 13D and 13R, various design consideration and installation parameters for a fire protection system. NFPA 13, 13D, and 13R recognize the use of residential sprinklers by requiring that such sprinkler in a residential fire protection system to be installed based on certain criteria for residential occupancies, which can include commercial dwelling units (e.g., rental apartments, lodging and rooming houses, board and care facilities, hospitals, motels or hotels).

In order, however, for a residential sprinkler to be approved for installation under NFPA Standards, such sprinkler must pass various tests promulgated by, for example, Underwriters Laboratory Incorporated ("UL") in its *Underwriter's Laboratory Residentialfire sprinklers for Fire-Protection Service* 1626 ("UL Standard 1626") in order to be listed for use as a residential sprinkler. Specifically, UL 1626 (October 2003) requires a sprinkler, as described in Table 6.1 of Section 6, to deliver a minimum flow rate (gallons per minute or "GPM") for a specified coverage area (square feet or "$ft^2$") to provide for a desired average density of 0.05 $GPM/ft^2$. The minimum flow rate tabulated in Table 6.1 can be used to calculate a predicted minimum fluid pressure needed to operate a sprinkler by virtue of a rated K-factor of the sprinkler. A rated K-factor of a sprinkler provides a coefficient of discharge of the flow passage of the sprinkler, is defined as follow:

$$K\text{-factor} = \frac{Q}{\sqrt{p}}$$

where Q is the flow rate in GPM and p is pounds per square inch gauge)

In order for a sprinkler to pass actual fluid distribution tests, as described in Sections 26 and 27 of UL 1626, the actual minimum pressure of the sprinkler, however, may not be the same as the predicted minimum pressure, which can be calculated using the given minimum flow rate of Table 6.1 in UL 1626 and the rated K-factor of the sprinkler. Further, the actual minimum fluid flow rate to pass these distribution tests of UL 1626 for a specified coverage area may even be higher than the tabulated minimum flow rate given in Table 6.1 of UL 1626. Consequently, any attempt to provide for a listed sprinkler (i.e., an operational sprinkler suitable for the protection of a dwelling unit) cannot be predicted by applications of a known formula to known residential sprinklers.

Known residential fire sprinklers have been tested to meet these performance qualifications required by UL 1626. When these known sprinklers are designed to be installed in an actual system according to the 2002 Edition of NFPA 13, 13, and 13R (2002) for a large protection area of 324 square feet or greater, however, these existing residential fire sprinklers require a fluid pressure, based on its discharge coefficient or K-factor, that places a greater demand on the fluid pressure source than that predicted by the application of the tabulated minimum flow rate of UL 1626 and the rated K-factor.

For example, a known 4.9 K-factor residential sprinkler can provide the required minimum flow rates of 20 GPM to pass the distribution tests for a 20 feet by 20 feet coverage area whereas another commercially available 4.9 K-factor residential sprinkler by another manufacturer cannot. Another 4.9 K-factor residential sprinkler has satisfied the UL 1626 testing requirements for a 18 feet by 18 feet coverage area with the actual flow rates for these UL 1626 tests being the same as the required minimum flow rates in Table 6.1 of UL 1626 and at a pressure predicted by the 4.9 K-factor value. A known larger K-factor sprinkler of 5.8 K-factor, however, operates at a higher flow rate (19 GPM) than the permitted minimum flow rate (17 GPM) for a coverage area of at least 324 square feet and at a higher pressure (10.8 psi) than a predicted pressure (8.6 psi) based on its K-factor value and permitted minimum flow rate of 17 GPM. Thus, these examples show that there is a great amount of uncertainty in any potential sprinkler design that cannot be determined unless the sprinkler is built and tested in accordance with a testing or listing authority.

Notwithstanding the inability of known sprinklers to operate at the predicted pressure value for a specified coverage area and minimum flow rate required by the listing authority, it would nevertheless be beneficial to provide for a residential sprinkler to achieve a lower pressure demand as compared to existing residential fire sprinklers while meeting the performance requirements of listing authority, such as, for example, the tests set forth in UL 1626 (October 2003), including vertical and horizontal fluid distribution tests. The lower pressure demand of such residential fire sprinkler would allow a fire protection system designer to have greater leeway in residential applications that are installed in accordance with NFPA 13, 13D, and 13R (2002)

for a design protection area under the NFPA Standards. Further, the lower pressure demand of such sprinkler would provide a minimum design pressure that will allow such designer to tailor the flow rate requirements demanded by the design protection area to the sprinkler with the best flow rate and pressure for a system installed in accordance with the 2002 Edition of NFPA 13, 13, and 13R.

SUMMARY OF THE INVENTION

The present invention provides a residential fire sprinkler that delivers fluid flow at a substantially lower minimum design pressure compared to existing residential pendent fire sprinklers while meeting performance tests for certain coverage areas. This ability of the sprinkler to meet testing requirements of UL 1626 (or other listing standard) allows the sprinkler to be listed so that the sprinkler qualifies as a residential sprinkler for installation in accordance with the 2002 Edition of NFPA 13, 13, and 13R (2002). Specifically, the residential fire sprinkler embodying a preferred embodiment of the present invention was able to meet the performance tests of UL 1626 at 30 percent lower operating pressure than a known residential fire sprinklers for design protection areas of 18 feet by 18 feet or greater. Hence, the sprinkler has a minimum pressure at which it is designed to operate at a specified coverage area in residential applications, which minimum pressure is lower than those of known sprinklers. And because the sprinkler has various minimum operating pressures that are lower than known residential sprinklers for respective specified coverage areas, the sprinkler provides an advantageous feature that advances the state of the fire protection art.

In one aspect of the present invention, a pendent type residential fire sprinkler is provided. The residential fire sprinkler includes a body, closure, heat responsive trigger, at least one frame arm, and a deflector. The body defines a passageway between an inlet and an outlet along a longitudinal axis with the outlet closer to an area to be protected than the inlet. The passageway has a rated K-factor of at least 6. The closure is positioned proximate the outlet opening so as to occlude the passageway. The heat responsive trigger retains the closure to occlude the passageway. The at least one frame arm being coupled to the body. The deflector is coupled to the at least one frame arm and spaced from the outlet opening so that, when the trigger is actuated, the deflector provides adequate fluid distribution for the protection of a dwelling unit. The deflector includes a first surface that faces the outlet and a second surface spaced apart from the first surface; a plurality of tines that extends away from the longitudinal axis, the plurality of tines being disposed generally about the longitudinal axis; and two slots formed through the first and second surfaces. Each slot includes two generally parallel walls between a first end and a second end to define an opening extending along a first axis generally perpendicular to a plane defined by the longitudinal axis and the at least one frame arm. The two walls of the slot converge towards each other at the first end and the second end to define a close-ended slot having a polygonal perimeter.

In another aspect of the present invention, a pendent type residential fire sprinkler is provided. The residential fire sprinkler includes a body, closure, heat responsive trigger, and a deflector assembly. The body defines a passageway between an inlet and an outlet along a longitudinal axis with the outlet closer to an area to be protected than the inlet. The passageway has a rated K-factor of at least 6. The closure is positioned proximate the outlet opening so as to occlude the passageway. The heat responsive trigger retains the closure to occlude the passageway. The deflector assembly is disposed along the longitudinal axis and spaced from the outlet opening so that, when the trigger is actuated, the deflector assembly provides adequate fluid distribution for the protection of a dwelling unit. The deflector assembly includes: a plurality of tines disposed about the longitudinal axis to define an outer perimeter, and a member having a slot whose length is at least twice as large as its width. The slot extends along a second plane that intersects the first plane. The slot is forms a close-ended boundary at a first end and forms a close-ended boundary at a second end spaced from the outer perimeter.

In another aspect of the present invention, a residential fire sprinkler that connects to a piping network to protect a residential dwelling unit having a plurality of compartments as defined in accordance with the 2002 Edition of National Fire Protection Association Standards 13, 13D and 13R is provided. The residential fire sprinkler includes a body, closure, heat responsive trigger, and a deflector assembly. The body defines a passageway between an inlet and an outlet along a longitudinal axis with the outlet closer to an area to be protected than the inlet. The closure is positioned proximate the outlet opening so as to occlude the passageway. The heat responsive trigger retains the closure to occlude the passageway. The deflector assembly distributes fluid fed to the inlet at less than 10 pounds per square inch gauge over a coverage area of at least 324 square feet and a density of at least 0.05 gallons per minute per square feet when the heat responsive trigger is actuated to permit flow through the outlet.

In a further aspect of the present invention, a residential fire sprinkler that connects to a piping network to protect a residential dwelling unit having a plurality of compartments as defined in accordance with the 2002 Edition of National Fire Protection Association Standards 13, 13D and 13R is provided. The residential fire sprinkler includes a body, closure, heat responsive trigger, and a deflector assembly. The body defines a passageway between an inlet and an outlet along a longitudinal axis with the outlet closer to an area to be protected than the inlet. The closure is positioned proximate the outlet opening so as to occlude the passageway. The heat responsive trigger retains the closure to occlude the passageway. The deflector assembly is coupled to the body so that the sprinkler can be installed in accordance with the 2002 Edition of National Fire Protection Association Standards 13, 13D and 13R to provide a suitable density for a minimum design pressure of less than 14 pounds per square inch gauge where a design protection area is about 400 square feet with a maximum distance of a generally linear side of the design protection area being no greater than 20 feet.

In yet a further aspect of the present invention, a residential fire sprinkler that connects to a piping network to protect a residential dwelling unit having a plurality of compartments as defined in accordance with the 2002 Edition of National Fire Protection Association Standards 13, 13D and 13R is provided. The residential fire sprinkler includes a body, closure, heat responsive trigger, and means for distributing fluid over a coverage area of a residential dwelling unit so that the sprinkler can be installed in accordance with the 2002 Edition of National Fire Protection Association Standards 13, 13D and 13R to provide a suitable density for a minimum design pressure of less than 14 pounds per square inch gauge where a design protection area is about 400 square feet with a maximum distance of a generally linear side of the design protection area being no greater than 20 feet. The body defines a passageway between an inlet and an outlet along a longitudinal axis with the outlet closer to an area to be protected than the inlet. The closure is positioned proximate the outlet opening so as to occlude the passageway. The heat responsive trigger retains the closure to occlude the passageway.

In another aspect, a method of protecting a coverage area with a fire sprinkler in a residential dwelling unit is provided. The dwelling unit has a plurality of compartments as defined in the 2002 National Fire Protection Association Standards 13, 13D, and 13R. The fire sprinkler has a body with an inlet and an outlet. The method can be achieved by supplying fluid to the inlet of a sprinkler at less than 14 pounds per square inch gauge; flowing fluid from the outlet at about 22 gallons per minute or less; and distributing fluid over a coverage area in accordance with Sections 26 and 27 of UL 1626 Standard (October 2003).

In a yet another aspect, a residential fire sprinkler is provided. The residential fire sprinkler has a body with a K-factor of at least 6 passage coupled to a deflector assembly that distributes fluid flow through the passage over a coverage area in accordance with UL 1626 (October 2003) so that ¾-inch NPT threads are provided on the body, which is coupled to a heat responsive trigger disposed between the passage and the deflector assembly, and the body can be installed in a sprinkler system designed in accordance with the 2002 Edition of NFPA 13, 13D, and 13R.

BRIEF DESCRIPTIONS OF THE DRAWINGS

The accompanying drawings, which are incorporated herein and constitute part of this specification, illustrate exemplary embodiments of the invention, and, together with the general description given above and the detailed description given below, serve to explain the features of the invention.

FIG. 4C illustrates a plan view of a layout for water collection pans in a horizontal fluid distribution test in one quadrant of a coverage area.

DETAILED DESCRIPTION OF THE PREFERRED EMBODIMENTS

Figure 1:
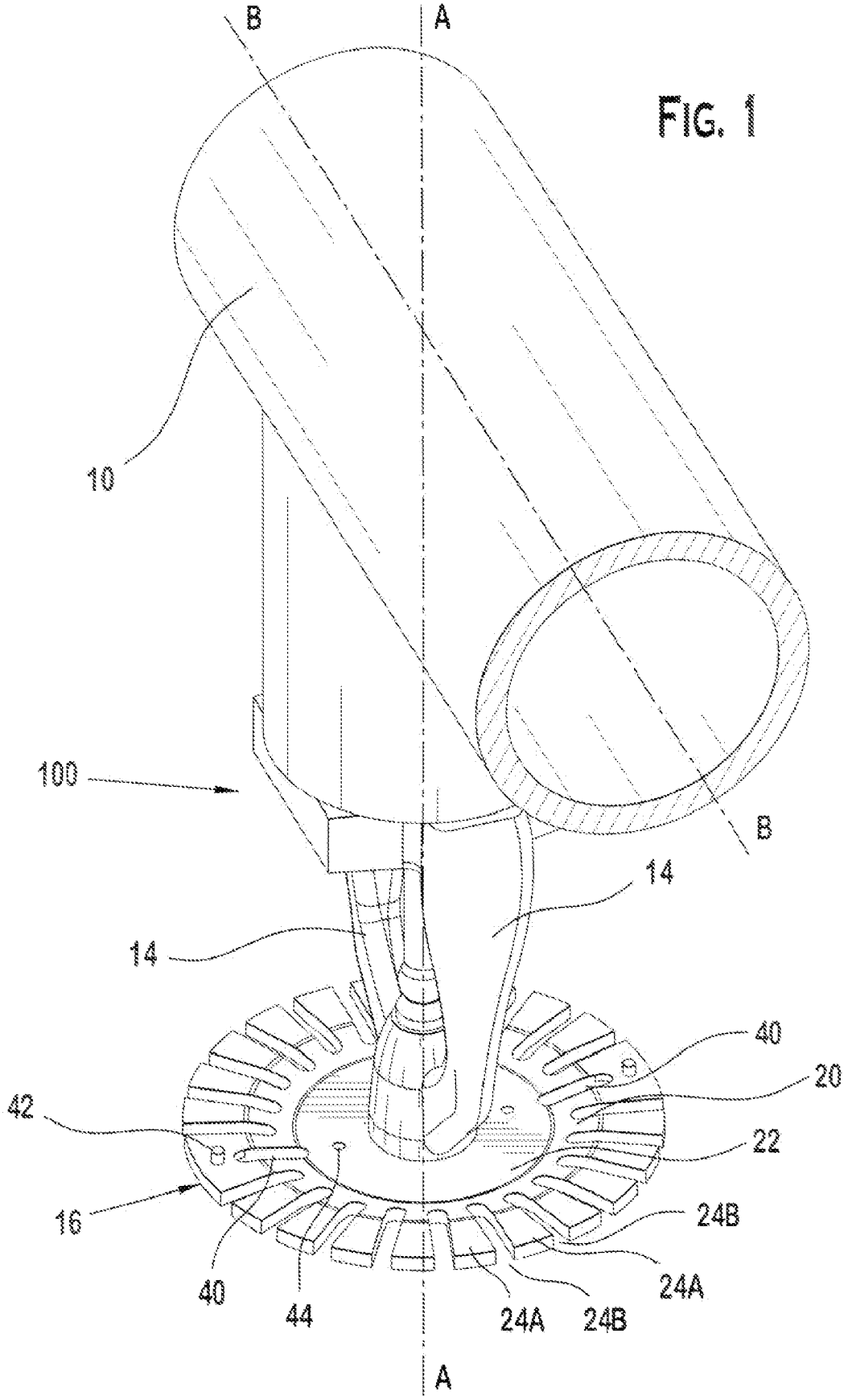
FIG. 1 is a perspective view of a preferred embodiment of the residential fire sprinkler as mounted to a branch pipe.
Figure 2:
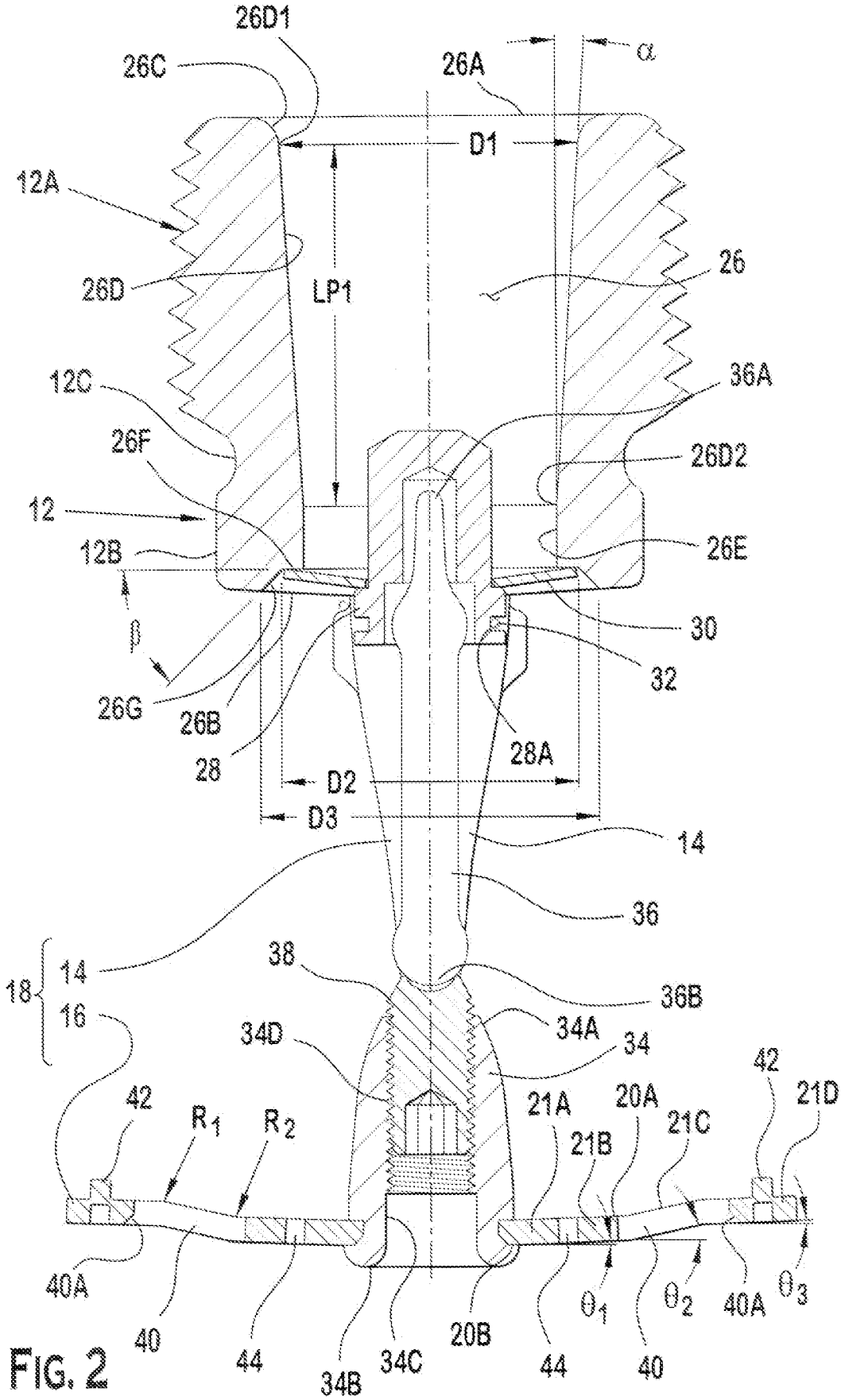
FIG. 2 is a cross-sectional view of the sprinkler of FIG. 1.
Figure 3A:
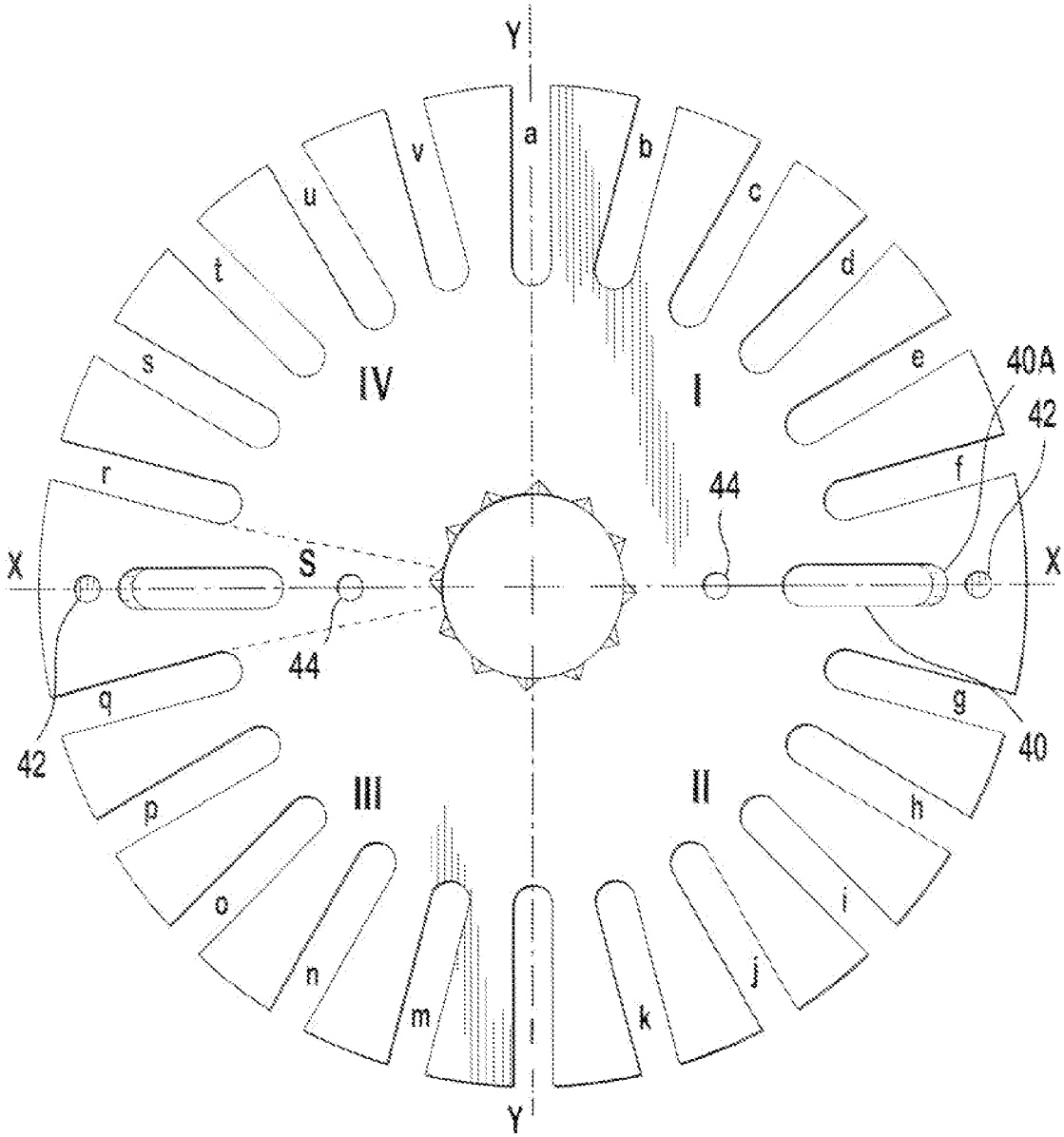
FIG. 3A is a plan view of a fluid deflecting plate of the sprinkler of FIG. 1 as seen by an observer directly below the sprinkler.
Figure 3B:
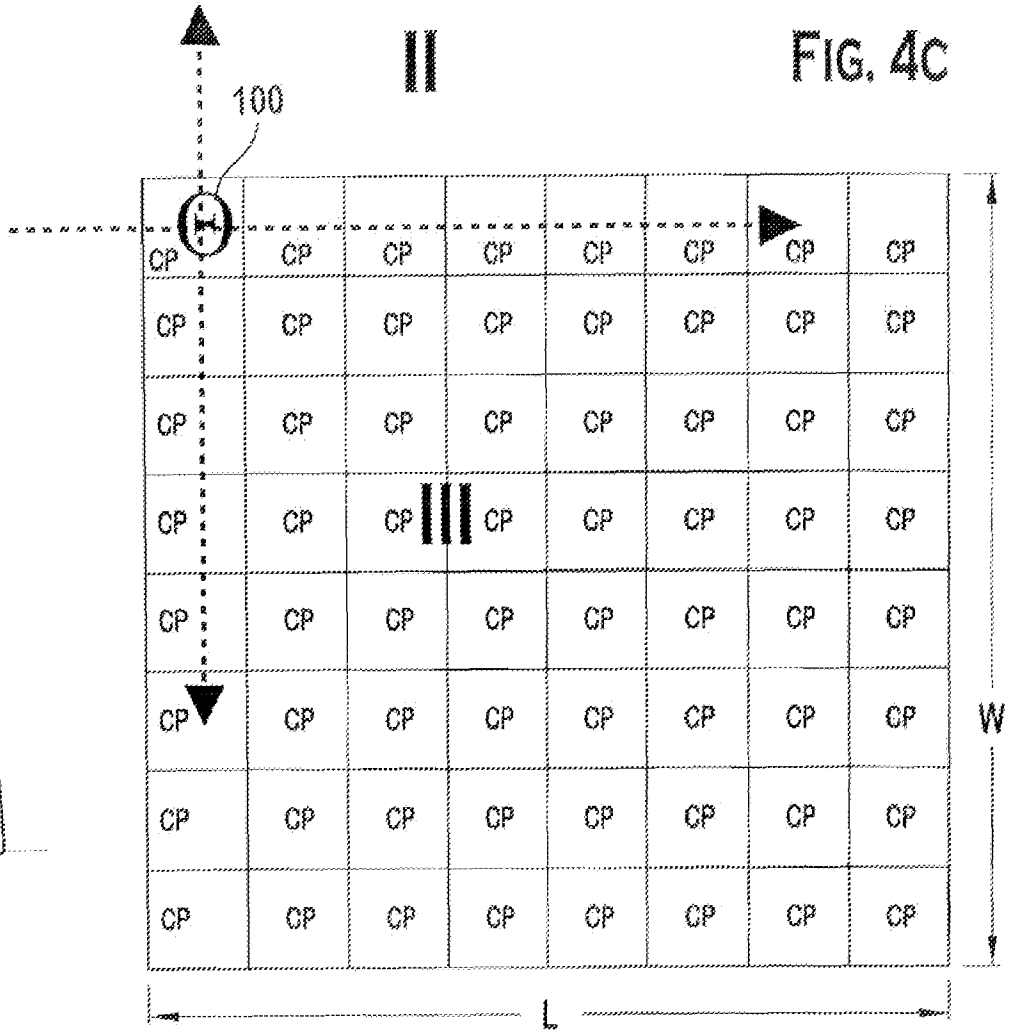
FIG. 3B is a plan view of a 90-degree sector of the fluid deflecting plate of FIG. 3A.
Figure 3B:
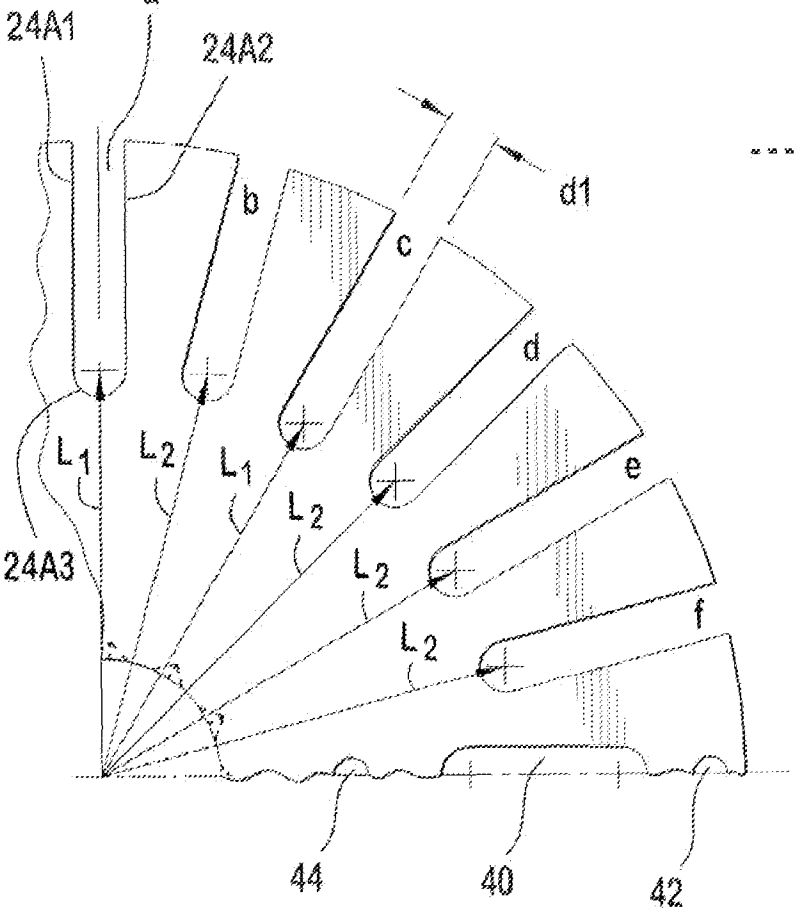

FIGS. 1–3 illustrate the preferred embodiments of a pendent type residential fire sprinkler 100 with a K-factor of at least 6 that can be used in residential applications. Referring to FIG. 1, a preferred embodiment of the residential sprinkler 100 is shown mounted to a fire protection piping 10 that extends along axis B—B. The residential sprinkler 100 is preferably a pendent sprinkler configuration oriented generally along axis A—A, which is generally orthogonal over an area to be protected. The area to be protected can be generally a floor area of a compartment in the residential dwelling unit.

As used herein, the term "residential" is a "dwelling unit" as defined in NFPA Standard 13D, 13R (2002), which can include commercial dwelling units (e.g., rental apartments, lodging and rooming houses, board and care facilities, hospitals, motels or hotels) to indicate one or more rooms, arranged for the use of individuals living together, as in a single housekeeping unit, that normally have cooking, living, sanitary, and sleeping facilities. The residential dwelling unit normally includes a plurality of compartments as defined in the 2002 Edition of NFPA 13, 13, and 13R (2002), where generally each compartment is a space that is enclosed by walls and ceiling. The standards relating to residential fire protection, including 2002 Standards 13, 13D, and 13R, as promulgated by, for example, the National Fire Protection Association ("NFPA Standard 13 (2002)", "NFPA Standard 13D (2002)", "NFPA Standard 13R (2002)") and *Underwriter's Laboratory Residentialfire sprinklers for Fire-Protection Service* 1626 (October 2003) ("UL Standard 1626 (October 2003)"), are incorporated herein by reference in their entireties.

As used herein, a discharge coefficient or K-factor of the sprinkler 100 is quantified or rated as a flow of water Q through a passageway 26 of the body 12 of the sprinkler 100 in gallons per minute (GPM) divided by the square root of the pressure p of water fed into body 12 in pounds per square inch gauge (psig), where $$K = \frac{Q}{\sqrt{p}}.$$

The discharge coefficient or K-factor relates in part to the shape of the passageway 26 and other dimensions of the passageway 26 of the sprinkler 100.

The pendent residential sprinkler 100 includes a body 12 with frame arms 14 extending from a portion of the body 12. The frame arms 14 can be unitary with a boss 34 that retains an annular structure 16 so that both the frame arms 14 and the annular structure 16 provide a fluid deflecting assembly 18. The annular structure 16 is preferably in the form of a plate 20. The plate 20 can include a generally concave or dished portion 22 about the longitudinal axis A—A. The plate 20 is also provided with a plurality of tines 24A oriented about the longitudinal axis A—A. Two close-ended slots 40 are located at about 90 degrees with respect to the frame arms 14. Two nubs 42 and two through-openings 44 are also located 90 degrees with respect to the frame arms 14.

Referring to the cross-sectional side view of FIG. 2, the body 12 has an outer surface provided with a threaded portion 12A and multiple-flat portion 12B connected by a transition portion 12C. The threaded portion 12A can preferably include threads greater than ½ inch National-Pipe-Thread ("NPT") and preferably ¾ inch-NPT threads. The flat portion 12B can include a four-sided flat for engagement with an installation tool. The body 12 is provided with a passageway 26 that extends from an inlet 26A to an outlet 26B along the longitudinal axis A—A over a length of less than one inch. The inlet 26A includes a generally planar entrance surface disposed about the longitudinal axis A—A. Similarly, the outlet 26B includes a generally planar exit surface disposed about the longitudinal axis A—A.

The inlet 26A includes a compound curved portion 26C defined by a radiused surface rotated about the longitudinal axis A—A to define a generally bellmouth shaped surface.

The compound curved portion 26C is contiguous to a first end of tapered linear surface 26D disposed about the longitudinal axis A—A to define a conic passageway portion 26D of a first length LP1 along the longitudinal axis A—A with a first taper angle α with respect to the longitudinal axis A—A. The first end 26D1 of the conic passageway portion 26D has a first diameter D1. The conic passageway portion 26D is contiguous to a cylindrical passageway portion 26E at a second end 26D2 of the conic passageway 26. The second end 26D2 of the conic passageway 26 and the cylindrical passageway portion 26E have a second diameter D2 of preferably about 86 percent of the first diameter D1. The cylindrical passageway 26 is contiguous to a flared generally planar surface portion 26F, which is contiguous to a passageway chamfered portion 26G. The flared generally planar portion has a third diameter D3 of preferably about 110 percent of the second diameter D2. The passageway chamfered portion 26G has a taper disposed about the longitudinal axis A—A to define a conic cylinder. The taper of the passageway chamfered portion 26G has a second taper angle β with respect to the longitudinal axis A—A. Preferably, the bellmouth portion includes a radius of curvature of less than about 0.1 inches; the first length LP1 of the conic passageway 26 is about 0.8 inch; first diameter D1 is about 0.6 inch; second diameter D2 is about 0.5 inch; third diameter D3 is about 0.6 inch; convergent first angle α of about 4 degrees with respect to the longitudinal axis A—A, the divergent second angle β of about 45 degrees with respect to the longitudinal axis A—A, and a suitable surface finish of the passageway 26 of preferably less than 100 micro inch. It is believed that at least these features provide for the achievement of a rated discharge coefficient or rated K-factor of at least 6 and more preferably, about 6.9.

The outlet 26B of the sprinkler 100 can be provided with a plug 28 coupled to a washer 30 so that the perimeter of the washer 30 is contiguous to the flared planar surface. The plug 28 can be provided with a groove 28A so that an ejection spring 32 can be mounted in the groove 28A and two free ends of the ejection spring 32 are coupled to the respective frame arms 14 on one of two boss projections of the frame arm (FIG. 2).

Referring to FIGS. 1 and 2, at least one frame arm 14 extends from the multiple-flat portion 12B proximate the outlet 26B. The at least one frame arm 14 has various cross-sections as the arm 14 extends away from the outlet. Preferably, two frame arms 14 extend generally along the longitudinal axis and converge towards each other with a boss 34 disposed between the two frame arms 14. The boss 34 has a tip portion 34A facing the outlet 26B. The tip portion 34A is disposed at preferably about less than one inch from the generally planar flared portion 26F of the passageway 26 and located at less than 3 inches from the inlet 26A end of the body 12. A stepped portion is provided between the tip portion 34A and the tail portion 34B of the boss 34 so that the annular plate 20 can be mounted thereon. The boss 34 includes a counterbore portion 34C and an internally threaded passageway 34D. The counterbore portion 34C preferably has a diameter of about 0.2 inches and extends along the longitudinal axis A—A of about 0.2 inches. The internally threaded portion 34D preferably has 10–32 UNF threads that extend along the longitudinal axis A—A of about 0.4 inches.

A heat responsive trigger 36 can be provided between the boss 34 and the plug 28. The trigger 36 has a first trigger end 36A located in a recess of the plug 28 and a second trigger end 36B abutting a loading screw 38. The loading screw 38 is threaded to the internally threaded portion 34D of the boss 34. Preferably, the loading screw 38 is threaded towards the outlet 26B so that the trigger 36 and plug 28 cause a deflection of the washer 30, preferably a Bellville type, Beryllium Nickel washer 30 with a Teflon® coating, of about 0.02 inches. In the preferred embodiments, the trigger 36 is a frangible bulb with an actuation temperature of about 155 or about 175 degrees Fahrenheit.

The annular plate 20 can be mounted to the tail portion 34B of the boss 34 and a part of the terminal end portion of the boss 34 can be flared or crimped so as to retain the annular plate 20 to the boss 34. Alternatively, a rivet can be used to retain the plate 20 to the boss 34.

Referring to FIG. 3A, the annular plate 20 includes twenty-two tines 24A and twenty-two open-ended slots 24B arrayed about the longitudinal axis A—A. Preferably, eleven tines are disposed at an interval of about 15 degrees about a semicircular sector between the axis X—X in alignment with two close-ended slots. The open-ended slot 24B is disposed between every two tines 24A and can be configured to have a closed portion proximate the central portion and an open portion proximate the perimeter of the plate 20. Each open-ended slot 24B has two walls 24A1 and 24A2 extending generally parallel to each other and spaced over a distance "d1" of preferably about 0.06 inches.

As shown in a 90-degree sector "I" of the plate 20 in FIG. 3B, the two walls 24A1 and 24A2 of the open-ended slots 24B are contiguous to a semicircular wall 24A3 that defines the closed end portion of the open-ended slot. The semicircular wall 24A3 for each open-ended slot includes a center located at one of a generally transverse distance L1 or L2 from the longitudinal axis A—A. Viewing the centers designated as "a–f" clockwise, it can be seen that the center of open-ended slot "a" is located on the Y—Y axis at 90 degrees from the X-axis. The second center of open-ended slot "b" is at least 65 degrees from the X—X axis; the third center of open-ended slot "c" is about 60 degrees from the X—X axis; the fourth center of open-ended slot "d" is about 45 degrees; the fifth center of open-ended slot "e" is about 30 degrees; and the sixth center of open-ended slot "f" is about 15 degrees. For each 90 degrees sector of the plate 20 there are two open-ended slots 24B whose centers, as delineated by L1 extending to "a" and "c", are closer to the longitudinal axis A—A than the remaining open-ended slots 24B b, c, d, e, and f in each 90 degrees sectors. For example, sector "II" is a mirror image of sector "I" with respect to the X—X axis so that open-ended slots 24B "j" and "l" are closer to the longitudinal axis A—A; sector "III" is a mirror image of sector "II" with respect to the Y-axis so that open-ended slots 24B "l" and "n" are closer to the longitudinal axis A—A; and sector "IV" is a mirror image of sector "I" with respect to the Y—Y axis so that open-ended slots 24B "u" and "a" are closer to the longitudinal axis A—A.

Figure 4A:
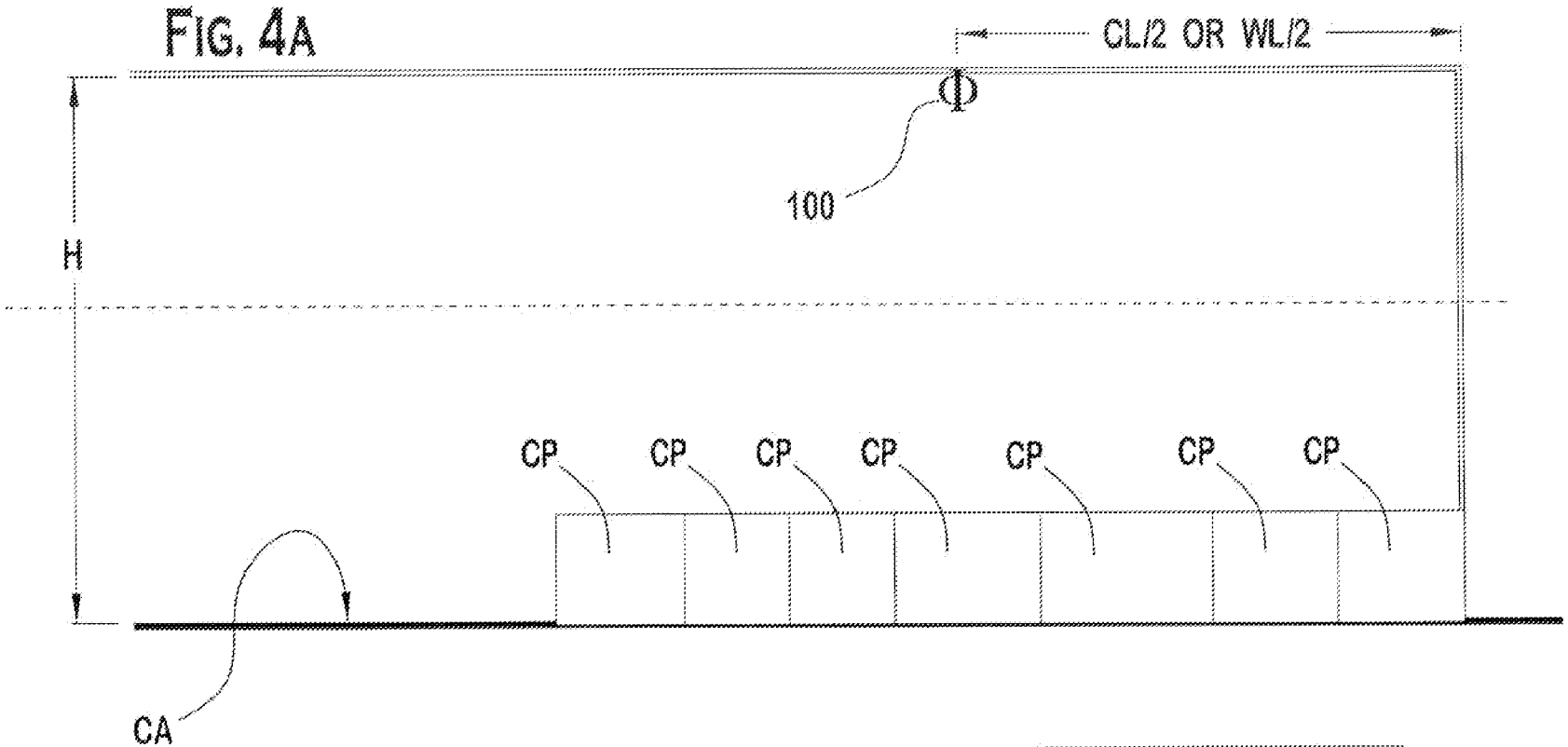
FIG. 4A is a plan view of a sprinkler in a test room to determine a vertical water distribution.
Figure 4B:
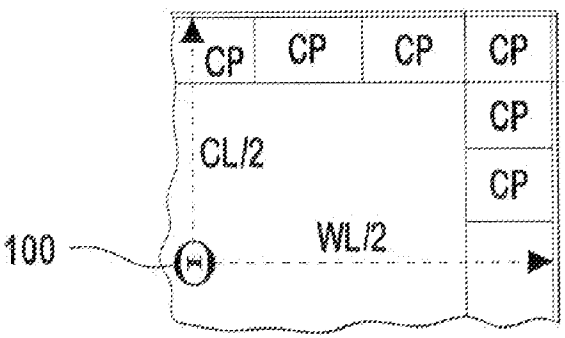
FIG. 4B is a top plan view of a vertical water distribution of the room of FIG. 4A.

These preferred design features of the tines 24A, open-ended slots 24B, and portions of the frame arms 14 of the deflector assembly 18 are the means for distributing fluid. Furthermore, the design features allow the sprinkler 100 is able to meet the testing requirements of UL 1626 (October 2003) including a vertical fluid distribution test illustrated in FIGS. 4A and 4B for various coverage areas such as, for example, 18 feet by 18 feet and 20 feet by 20 feet.

Under this test, as promulgated by Section 27 of UL Standard 1626 (October 2003), the test provides for an arrangement to determine the vertical fluid distribution of any sprinkler suitable for the protection of a dwelling unit. In the test arrangement for the residential pendent sprinkler 100, the sprinkler 100 is placed over a center of a coverage area CA at one-half the coverage length CL or width CW (FIGS. 4A and 4B) of the coverage area. A suitable fire-fighting fluid such as water is delivered to the sprinkler 100 at a specified flow rate with the sprinkler 100 being tested via a one-inch internal diameter pipe. Water collection pans of one-square foot area are placed on the floor against the walls of the test area so that the top of the pan is six feet, ten inches below a nominally eight feet height H generally flat ceiling. The duration of the test is ten minutes at which point the walls within the coverage area should be wetted to within 28 inches of the ceiling at the specified design flow rate. Where the coverage area is square, each of the four walls must be wetted with at least five percent of the sprinkler flow. Where the coverage area is rectangular, each of the four walls must be wetted with a proportional water amount collected that is generally equal to 20 percent times a total discharge of the sprinkler 100 at the rated flow rate of the residential fire sprinkler times the length of the wall divided by the perimeter of coverage area CA.

Besides the utilization of the plurality of tines 24A for vertical distribution of fluid, the dished plate 20 can be optionally provided with three other fluid flow modifiers: (1) a close-ended slot 40, (2) a nub 42 oriented along an axis X—X generally perpendicular to a plane defined by the two frame arms 14 and the longitudinal axis A—A, and (3) a through opening on the same axis X—X. A mirror image of these flow modifiers are also preferably provided with respect to the Y—Y axis.

As shown in FIGS. 2 and 3A, the wall of each of the close-ended slots 40 extends through the dished plate 20 between a first end closer to the longitudinal axis A—A and a second end oriented radially away from the first end further away from the longitudinal axis A—A along a plane defined by axes X—X and A—A that intersects another plane defined by axes Y—Y and A—A. The close-ended slot 40 is provided on a sector S delineated by extensions of the edges of slots "r" and "s" towards the longitudinal axis to define an arcuate wedge or pie shaped section. A portion of the curved wall of each of the close-ended slots 40 is configured with a close-ended slot chamfer 40A proximate the second end spaced from the outer perimeter defined by the plurality of tines 24A. The length of the slot 40 along the plane (defined by axes X—X and A—A) is preferably twice as great as its width. Proximate the second end of each slot is a nub 42. The nub 42 can be any surface irregularity on the deflector 16 and is preferably a cylindrical projection that extends towards the outlet 26B. Proximate the first end of each close-ended slot 40 is a through-opening 44.

As shown in the plan view of the bottom surface 20B of the deflector plate 20 in FIG. 3A, the center of the nub 42 is aligned with both the close-ended polygonal slot and a center of the through-opening 44 along axis X—X. Moreover, as shown in FIG. 1, the nubs 42, close-ended polygonal slots 40 and through openings 44 are aligned about 90 degrees with respect to the frame arms 14 which are aligned along the axis B—B of the fire protection piping 10. Although the close-ended slots 40 are illustrated as being formed on the deflector 16 of the deflector assembly 18, the close-ended slots can be provided on a separate member from the deflector 16. Similarly, the nubs 42 and through-openings can also be provided on the separate member or on yet another separate member. Preferably, the close-ended slot chamfer 40A forms a taper diverging from the longitudinal axis A—A of about 45 degrees, the nub 42 has a diameter as long as its length with its center located at less than one inch from the longitudinal axis A—A, and the through-opening 44 is a generally circular through-opening 44 of about the same diameter as the nub and located at less than ½ inch from the longitudinal axis A—A.

It is believed that the features of the nubs 42 allow for compliance with the operational test of Section 22 of UL 1626 (October 2003) where the pendent sprinkler 100 is actuated adjacent to a unactuated second pendent sprinkler 100 located at 8 feet from the actuated sprinkler 100. In particular, while the first pendent sprinkler is discharging fluid at 100 psig or more, the first pendent sprinkler 100 cannot prevent the actuation of the second pendent sprinkler 100 as the second sprinkler is being exposed to heat and flame, as provided for in Subsection 22.2 of UL 1626 (October 2003). At approximately 100 psig or greater, it is believed that the fluid flowing radially along the surfaces of the deflector 16 has sufficient velocity to produce flow separation by the nubs 40. Consequently, while the nubs 40 are shown as cylindrical projections, any surface irregularity on the deflector 16 sufficiently large enough to cause flow separation at fluid pressure of 100 psig or greater, would operate to prevent wetting of adjacent sprinklers located 8 or more feet in the directions of the plane defined by the X—X and A—A axes without the diminishing the effectiveness of the fluid distribution pattern provided by the deflector assembly 16. The nubs 42, however, are believed to have minimal effects on the fluid distribution pattern at fluid pressures substantially below 100 psig.

Referring to FIG. 1, the annular plate 20 shown here is preferably formed from a circular generally planar workpiece made of bronze with a first plate surface 20A facing the outlet 26B and a second plate surface 20B facing away. The planar workpiece can be stamped or deep drawn to provide the concave or dished configuration where the first and second surfaces are generally parallel to a first taper portion 21B at a first taper angle $\theta_1$ proximate a central portion 21A of the plate 20. The first taper portion 21B is contiguous to a second taper portion 21C at a second taper angle $\theta_2$, which is contiguous to a third taper portion 21D of the plate at a third taper angle $\theta_3$.

Referring again to FIG. 1, the annular plate 20 has a first plate surface 20A proximate the second tapered portion 21C, which includes first radius of curvature about a first centerline extending orthogonal to the longitudinal axis A—A. The annular plate 20 includes a second radius of curvature proximate the third tapered portion 21D about a second centerline generally parallel to the first centerline. Both of the radii of curvature for the surface 20A are disposed about the longitudinal axis.

Each of the close-ended and open-ended slots can extend from the second taper portion 21C to the third taper portion 21D. The nubs 40 can be located on the third taper portion 21D while the through-openings 44 are located at the proximate junction between the central plate portion 21A and first taper portion 21B. Preferably, each of the first and third taper angle $\theta_1$ or $\theta_3$ is about a first magnitude with respect to the X—X axis and the second taper portion angle $\theta_2$ is about 6 times the first magnitude $\theta_1$ with respect to the X—X axis.

The flow modifiers (e.g., nubs 42, through-openings 44, or polygonal slots 40) of the deflector assembly 18 can optionally be part of the means for distributing fluid in a residential dwelling unit so that the sprinkler 100 is able to meet testing requirements of UL 1626, including a horizontal fluid distribution test. In this test, UL Standard 1626 (October 2003) requires placing a selected sprinkler 100 over a protective area sub-divided into four quadrants with the sprinkler 100 placed in the center of the quadrants I–IV. A detailed layout of one quadrant is illustrated in FIG. 4C.

In this quadrant, water collection pans are placed over the quadrant (e.g., quadrant III) of the protective area so that each square foot of the quadrant is covered by collector pan of one-square foot area. For pendent sprinklers, the top of the collector pan is eight feet below a generally flat ceiling of the test area, FIG. 4A. The coverage area CA is generally the product of a coverage width CW and length CL such as, for example, 18 feet by 18 feet or 20 feet by 20 feet. The length L of the quadrant III is generally the one-half the coverage length CL and the width W is generally one-half the coverage width CW, where each square foot of the quadrant is covered by collection pans of one-square foot area with the top of each collection being about eight feet below a generally flat ceiling of the coverage area and the amount of fluid collected is about 0.02 gallons per minute per square foot for any of the collection pans except that no more than four collection pans for each quadrant receive at least 0.015 gallons per minute per square foot.

Water or a suitable fire fighting fluid is supplied to the selected sprinkler 100 at a desired rate with the sprinkler 100 being tested via a one-inch internal diameter pipe with a T-fitting having an outlet at substantially the same internal diameter as the inlet 26A of the selected sprinkler 100. The duration of the test is twenty-minutes and at the completion of the test, the water collected by the collection pan CP (as delineated by the square like grid) is measured to determine if the amount deposited complies with the minimum density requirement for each coverage area.

As utilized in this test, the nub 42 is believed to allow the break up of the flow stream extending from the outlet 26B perpendicular to the frame arms 14 in order to meet an 8-foot spacing between sprinklers in the operational test of Section 22 of UL 1626 (October 2003). The closed ended slot 40 is believed to provide for a sufficient fluid distribution over the test coverage area perpendicular to the frame arms 14. The close-ended slot chamfer 40A on the second end of each closed ended slots also contributes to the sprinkler 100 meeting the coverage area distribution requirements for this test. It is believed that each close-ended slot chamfer 40A allows a collection pan CP perpendicular to the frame arms 14 and furthest to the frame arms 14 to receive a sufficient fluid quantity to meet the requirements of this test.

Further, it is believed that the features described above in relation to the deflector assembly 18 allows the sprinkler to provide a flow rate of 19 gallons per minute of water at a pressure of less than 10 pounds per square inch gauge fed to the inlet 26A so that a sufficient density of water is provided to a coverage area of 18 feet by 18 feet under both the vertical and horizontal distribution tests of UL 1626 (October 2003). Furthermore, the features described above in relation to the deflector assembly 18 also allow the sprinkler to provide a flow rate of 22 gallons per minute at a pressure of less than 10 pounds fed to the inlet for a coverage area of 20 feet by 20 feet under both the vertical and horizontal distribution tests of UL 1626 (October 2003).

Besides the above described fluid distribution tests, actual fire tests can also be performed in accordance with UL Standard 1626 (October 2003) for the preferred embodiments. In particular, three tests arrangement can be utilized within a room with nominally eight feet generally horizontal or flat ceiling and simulated furniture so that the tested residential fire sprinkler 100 can limit temperatures at four different locations to specified temperatures. Details of these tests are shown and described in UL 1626 (October 2003).

In addition to the design features the preferred embodiments that allow the sprinkler 100 to meet the testing requirements of UL 1626, the annular plate 20 of the sprinkler 100 is provided with the dished and multiple tapered portions that are believed to allow the preferred sprinkler 100 to be used in at least three different mounting configurations such as, for example, a pendent, recessed pendent, or concealed pendent mounting configurations.

In the pendent configuration, the preferred embodiment can be installed so that the deflector first plate surface 20A exposed to the outlet 26B is about 1.5 to 4 inches from a ceiling. In the recessed pendent configuration, the first plate surface 20A of the deflector can be about 1.4 inch from the ceiling surface with adjustments of ¼ inches in any one vertical direction. In the concealed pendent configuration, the deflector is located at about ¼ inch from the ceiling surface.

It is believed that the preferred embodiments disclosed herein are the first residential sprinklers 100 with a K-factor greater than 4.9 that can be used in all three mounting configurations. This multiple mounting capability of the preferred embodiment is believed to be advantageous to a fire protection designer because one type of sprinkler can be used regardless of the aesthetics and functional requirements of the system designer.

Although the preferred embodiments are provided with a variety of features that allows the sprinkler 100 to be listed for installation in any of the three mounting configurations discussed above, the features described herein can be utilized in various combinations with a sprinkler body of ¾ inch or greater threaded body to provide for a residential sprinkler in accordance with applicants' teaching with regard to the preferred embodiments. Furthermore, the combinations of features can also be provided with variations in each of these features to allow a ¾ inch threaded sprinkler body with these variations to be listed under UL 1626 (October 2003) at a minimum operating pressure of less than 10 pounds per square inch gauge for a coverage area of at least 324 square feet and installed in accordance with NFPA 13, 13D, and 13R (2002). These variations would include, for example, a variation in the particular relationship of the taper angles $\theta_1$, $\theta_2$, and $\theta_3$ for the dished annular plate 20 as a function of the installation; the number of tines 24A along with variations in the width between the tines 24A, radius of curvature and location of the terminal portion 24A3 of each open-ended slot 24B; the nub 42 can be in a configuration other than cylindrical while its height above the plate surface 20A may be varied depending on the installation sprinklers in a design; the length or width of the close-ended slots 40 can be smaller or larger depending on the targeting of fluid spray below the deflector 20; the close-ended slots 40 may be offset instead of being aligned with each other along the first axis X—X; the chamfer 40A of the close-ended slots 40 can be modified to provide for a different taper angle or a combination of taper angles; the through-opening 44 can be in a configuration other than a right circular cone with variation in the cross-section of the through-opening; the location of the through-opening 44 at a location other than aligned with the close-ended slots 40 or the nubs 42; the close-ended slots 40, through-openings 40 and nubs 42 can be provided on a member separate from the plurality of tines 24A; the nubs 42 can be a portion of the separate member folded or bent towards the outlet to provide a surface irregularity; variations in the relationship between the diameters D1, D2, and D3 of various sections of the fluid passage 26 including the taper angles $\alpha$ and $\beta$; variations in the cross-sections of each frame arm; the shape of the boss 34 and its location relative to the outlet 26B; or the type of seal 30 or plug 28 and the extent in which the plug 28 can protrude into the fluid passage 26.

Finally, because the preferred embodiments of the sprinkler 100 are able to pass all of the performance tests required by UL 1626 (October 2003), the preferred embodiments are able to be listed by a listing authority, such as, for example, UL, for design and installation as a residential fire sprinkler, as defined in Section 3.6.2.10 of NFPA 13 (2002). With these features, the preferred embodiments can be installed in any one of three different mounting configurations, in a residential fire protection system, in accordance with NFPA 13, 13D and 13R (2002) at lower minimum design pressures for design protection area of 324 square feet or greater. Consequently, at least the annular plate 20, frame arm, slots and tines are preferably the means for distributing fluid over a coverage area of a residential dwelling unit so that the sprinkler can be installed in accordance with the 2002 Edition of National Fire Protection Association Standards 13, 13D and 13R to provide a suitable density for a minimum design pressure of less than 14 pounds per square inch gauge where a design protection area is about 400 square feet with a maximum distance of a generally linear side of the design protection area being no greater than 20 feet. And with the lower minimum design pressures, the preferred embodiments can be utilized in the design of fire protection system for coverage area of 324 square feet of greater at approximately 30 percent lower design pressure than known residential fire sprinklers.

While the present invention has been disclosed with reference to certain embodiments, numerous modifications, alterations, and changes to the described embodiments are possible without departing from the sphere and scope of the present invention, as defined in the appended claims. Accordingly, it is intended that the present invention not be limited to the described embodiments, but that it has the full scope defined by the language of the following claims, and equivalents thereof.

We claim:

1. A residential fire sprinkler comprising:

a body defining a passageway between an inlet and an outlet along a longitudinal axis with the outlet closer to an area to be protected than the inlet, the passage including a rated K-factor of at least 6, the body including a portion having ¼ inch or greater NPT threads formed thereon;

a closure positioned proximate the outlet so as to occlude the passageway;

a heat responsive trigger that retains the closure to occlude the passageway;

at least one frame arm being coupled to the body at one end and a boss at another end so that a portion of the frame arm is contiguous to a first plane extending generally parallel to the longitudinal axis; and a deflector assembly disposed along the longitudinal axis and spaced from the outlet so that when the trigger is actuated, the deflector assembly provides adequate fluid distribution for the protection of a dwelling unit, the deflector including;

a plurality of tines disposed about the longitudinal axis to define a generally circular outer perimeter;

a member having a slot whose length is at least twice as large as its width, the slot extending along a second plane that intersects the first plane, the slot forming a close-ended boundary at a first end and further forming a close-ended boundary at a second end spaced from the outer perimeter.

2. The residential sprinkler of claim 1, wherein the deflector assembly further comprises a nub disposed on the second plane between the outer perimeter and the slot.

3. The residential sprinkler of claim 1, wherein the member comprises a portion between the outer perimeter and the slot having an irregular surface projecting towards the outlet.

4. The residential sprinkler of claim 1, wherein the second end of the slot comprises a chamfer surface tapered with respect to the longitudinal axis so that the chamfer surface faces away from the outlet.

5. A residential fire sprinkler comprising:

a body defining a passageway between an inlet and an outlet along a longitudinal axis with the outlet closer to an area to be protected than the inlet, the passage including a rated K-factor of at least 6, the body including a portion having ¼-inch or greater NPT threads formed thereon;

a closure positioned proximate the outlet opening so as to occlude the passageway;

a heat responsive trigger that retains the closure to occlude the passageway; at least one frame arm being coupled to the body; and a deflector coupled to the at least one frame arm and spaced from the outlet opening so that when the trigger is actuated, the deflector provides adequate fluid distribution for the protection of a dwelling unit, the deflector including:

a first surface that faces the outlet and a second surface spaced apart from the first surface;

a plurality of tines that extends away from the longitudinal axis, the plurality of tines being disposed generally about the longitudinal axis;

two slots formed through the first and second surfaces, each slot including two generally parallel walls between a first end and a second end to define an opening extending along a first axis generally perpendicular to a plane defined by the longitudinal axis and the at least one frame arm, the two walls of the slot converging towards each other at the first end and the second end to define a close-ended slot having a polygonal perimeter;

a nub located proximate the second end of at least one of the two slots, the nub projecting towards the outlet;

a generally first planar portion;

a first tapered portion that extends at a first taper angle with respect to the first axis from the generally first planar portion;

a second tapered portion extending from the first tapered portion at a second taper angle of about six times the first taper angle; and a third tapered portion extending from the second tapered portion at a third taper angle of about the same magnitude as the first taper angle, the nub being disposed on the third tapered portion and at least one of the slots being disposed on the second and third tapered portions.

6. The residential fire sprinkler of claim 5, wherein the nub comprises a cylindrical projection.

7. The residential fire sprinkler of claim 5, wherein each of the plurality of tines comprises a first wall adjacent to a second wall of an adjacent tine to define an open slot between the adjacent tines, the first and second walls contiguous to a terminal wall portion to bound at least one of the slots at a position proximal the longitudinal axis and spaced apart to define an unbounded portion distal to the longitudinal axis.

8. The residential fire sprinkler of claim 7, wherein the first end of at least one of the close-ended polygonal slots is closer to the longitudinal axis and the second end is further from the longitudinal axis, the second end including a chamfered surface extending generally oblique to the longitudinal axis.

9. The residential fire sprinkler of claim 8, wherein each of the first and second end of at least one of the close-ended polygonal slots comprises a wall surface curved about an axis extending generally parallel to the longitudinal axis through the deflector.

10. The residential fire sprinkler of claim 9, wherein the terminal wall portion of each open slot comprises a curved wall defined by a radius of curvature, the open slots including a first type of slot and a second type of slot, the curved wall of the first type of slot being located closer to the longitudinal axis than the curved wall of the second type of slot, the first type of slot including one slot disposed on a second axis generally perpendicular to the first and longitudinal axis and two slots adjacent to the one slot at about 30 degrees with respect to the one slot.

11. The residential fire sprinkler of claim 10, wherein the plurality of tines comprises eleven tines disposed over an interval of about 15 degrees about the longitudinal axis on each sector bounded by the first axis, each of the plurality of tines extends from the first tapered portion to the third tapered portion of the deflector.

12. The residential fire sprinkler of claim 11, wherein the first surface proximate the second tapered portion having first radius of curvature about a first centerline extending orthogonal to the longitudinal axis proximate the generally planar portion and a second radius of curvature proximate the third tapered portion about a second centerline generally parallel to the first centerline, the first and second radii of curvature of the first surface being disposed about the longitudinal axis.

13. The residential fire sprinkler of claim 12, wherein the at least one frame arm further comprises a boss having a center generally aligned with the longitudinal axis, the frame arm being coupled to the deflector contiguous to a plane orthogonal to both the first axis and the longitudinal axis.

14. The residential fire sprinkler of claim 13, wherein the passageway comprises a generally cylindrical passageway with a first portion converging towards the longitudinal axis at a convergent angle, the inlet of the passageway includes a chamfered portion and an entrance portion contiguous to the first taper portion, the entrance portion having a first inside diameter and a second portion proximate the outlet having a second diameter of about 86 percent of the first diameter, the outlet having an exit portion with a chamfer surface surrounding the longitudinal axis, the exit portion having a third diameter of about 109 percent of the first diameter and the chamfer having a divergent angle relative to the longitudinal axis of about 6 times the magnitude of the convergent angle.

15. The residential fire sprinkler of claim 5, wherein the first surface of the deflector being located at one of a plurality of positions spaced from ¼ inch to 5 inches with respect to a ceiling over the coverage area.

* * * * *

UNITED STATES PATENT AND TRADEMARK OFFICE

CERTIFICATE OF CORRECTION

PATENT NO. : 7,201,234 B2
APPLICATION NO. : 11/000128
DATED : April 10, 2007
INVENTOR(S) : Rogers et al.

It is certified that error appears in the above-identified patent and that said Letters Patent is hereby corrected as shown below:

Column 2, lines 26 and 27, please delete "NFPA 13, 13, and 13 R" and insert --NFPA 13, 13D, and 13R--;

Column 3, line 7, please delete "NFPA 13, 13, and 13 R" and insert --NFPA 13, 13D, and 13R--;

Column 3, line 19, please delete "NFPA 13, 13, and 13 R" and insert --NFPA 13, 13D, and 13R--;

Column 6, line 10, please delete "NFPA 13, 13, and 13 R" and insert --NFPA 13, 13D, and 13R--;

Column 8, line 35, please delete "at least 65 degrees" and insert --at least 75 degrees--;

Column 8, line 40, please delete "90 degrees sectors" and insert --90 degree sector--;

Column 8, line 44, please delete "b, c, d, e, and f" and insert --b, d, e and f--;

Column 8, line 44, please delete "90 degrees sectors" and insert --90 degree sector--;

Column 9, lines 36 and 37, please delete "edges of slots "r" and "s" and insert --edges of slots "q" and "r"--;

Signed and Sealed this
Eleventh Day of October, 2011

David J. Kappos

David J. Kappos
*Director of the United States Patent and Trademark Office*